US006749523B1

(12) United States Patent
Forzano

(10) Patent No.: US 6,749,523 B1
(45) Date of Patent: Jun. 15, 2004

(54) PUTTER

(76) Inventor: Richard J. Forzano, 46 Newman Rd., Wantage, NJ (US) 07461

( * ) Notice: Subject to any disclaimer, the term of this patent is extended or adjusted under 35 U.S.C. 154(b) by 0 days.

(21) Appl. No.: 09/760,291

(22) Filed: Jan. 16, 2001

Related U.S. Application Data

(63) Continuation-in-part of application No. 09/310,111, filed on May 12, 1999, now Pat. No. 6,379,264.
(60) Provisional application No. 60/111,157, filed on Dec. 7, 1998.

(51) Int. Cl.[7] ..... A63B 53/04; A63B 53/06
(52) U.S. Cl. ..... 473/330; 473/331; 473/336; 473/340; 473/332
(58) Field of Search ..... 473/324, 332, 473/330, 331, 334, 335, 336, 337, 338, 339, 340, 341, 349, 256, 251, 242, 226, 227, 350, 313

(56) References Cited

U.S. PATENT DOCUMENTS 645,942 A * 3/1900 Cran
1,320,163 A * 10/1919 Maurice
1,531,821 A * 3/1925 Scott
1,536,616 A * 5/1925 Manning
2,155,830 A * 4/1939 Howard
3,893,672 A * 7/1975 Schonher
D248,181 S * 6/1978 Cervantes
4,325,553 A * 4/1982 Taylor
4,413,825 A * 11/1983 Sasse
4,530,505 A * 7/1985 Stuff
4,811,950 A * 3/1989 Kobayashi
4,869,507 A * 9/1989 Sahm
5,026,056 A * 6/1991 McNally
5,090,702 A * 2/1992 Viste
5,244,210 A * 9/1993 Au
5,253,869 A * 10/1993 Dingle
5,390,919 A * 2/1995 Stubbs
5,435,559 A * 7/1995 Swisshelm
5,437,088 A * 8/1995 Igarashi
5,460,377 A * 10/1995 Schmidt
5,489,097 A * 2/1996 Simmons
D370,517 S * 6/1996 Butler
5,586,947 A * 12/1996 Hutin
5,676,605 A * 10/1997 Kobayashi
5,683,309 A * 11/1997 Reimers
5,688,189 A * 11/1997 Bland
5,709,616 A * 1/1998 Rife
5,769,737 A * 6/1998 Holladay
6,183,379 B1 * 2/2001 Kim
6,224,497 B1 * 5/2001 Antonious
6,379,264 B1 * 4/2002 Forzano

FOREIGN PATENT DOCUMENTS

GB 25564 * 12/1905 ..... 273/175

* cited by examiner

*Primary Examiner*—Sebastiano Passaniti
(74) *Attorney, Agent, or Firm*—Venable LLP; Andrew C. Aitken

(57) ABSTRACT

In a putter, at least one adjustable weight is provided which can be moved to different positions longitudinally along the putter head. The putter head is provided with a open channel with closed ends. The weight is slidably mounted within said outer chamber with bolts extending through a slot into a slide within the channel, and the bolt is adapted to be screw tightened into said slide to hold said weight in position. A vibration damping plate is disposed between the weight and the putter head. The front face of the putter is provided parallel vertical grooves defined in the front face, and the grooves are separated by flat lands between The grooves are arcuate in cross section so that the sidewalls of the groove slope is at an angle substantially less that perpendicular to the lands.

10 Claims, 7 Drawing Sheets

PUTTER

CROSS REFERENCE TO RELATED APPLICATION

This application is a continuation in part of application Ser. No. 09/310,111, filed May 12, 1999, now U.S. Pat. No. 6,379,264, which claims the benefit of Provisional Application Serial No. 60/111,157, filed Dec. 7, 1998.

BACKGROUND OF THE INVENTION

This invention relates to adjustable golf equipment and more particularly to a putter with an adjustable sweet spot and having a construction facilitating adjustment of the putter to compensate for a golfer's tendency to miss putts by misdirection.

Many different kinds and shapes of putters are available on the market and new putter models are continuously being developed. Some putters in the prior art employ adjustable weights to enable the sweet spot in the putter to be adjusted along the axis of the putter head. In one prior art putter, adjustable weights are screwed into a weight chamber extending from the heel to the toe of the putter and the threaded chamber is closed with threaded end plugs. The weights and the end plugs are provided with slots to receive a screw driver to enable adjustment of the weights. The above described putters of the prior art enable the sweet spot to be adjusted, but the weight adjustment is a very time consuming procedure. In another putter, the weights are in the form of truncated pyramids, which slide in trapezoidal slots in the putter head and while are held in place by screw bolts projecting from the back of the putter. This arrangement has the weights located within the slots. The arrangement limits the size of the weights, reducing the ability to provide much sweet spot adjustment and the trapezoidal slope to the slots makes manufacture difficult and expensive. This latter deficiency is alleviated somewhat by making the slots open ended, but this arrangement makes it easy for the weights to be slid entirely out of the slot, thus permitting them to become easily lost. Furthermore, the projecting bolts are susceptible to being knocked by external objects causing the weight assembly to come loose form the putter head.

In all of the adjustable weight putters of the prior art, there is also a tendency for the weight to vibrate against the putter head when the ball is struck, giving the golfer a bad feel in the stroke.

SUMMARY OF THE INVENTION

The present invention overcomes the problems of the prior art adjustable sweet spot putter by providing adjustable weights which are designed to permit a sliding motion within an outer chamber along a closed channel which runs longitudinally within the putter head. The weights comprise oval members which are fixed to the slides with bolts. The slides slide in the channel and the bolts extend through slots in a retainer plate closing the top of the channel. The bolts are tightenable in the slides to hold the weights against the retainer plate defining the slot by securing a slide to the opposite side of the slot to hold the weights in their selected position. The bolts are structured to be loosened and tightened with an allen wrench or a screw driver to enable sliding the weight along the channel to a new position.

The face of the putter is provided with small arcuate vertical grooves which improve the consistency of the contact of the putter face with the dimpled ball surface to give the golf ball struck with the putter face more consistency in its direction.

DESCRIPTION OF THE PREFERRED EMBODIMENT

Figure 1:
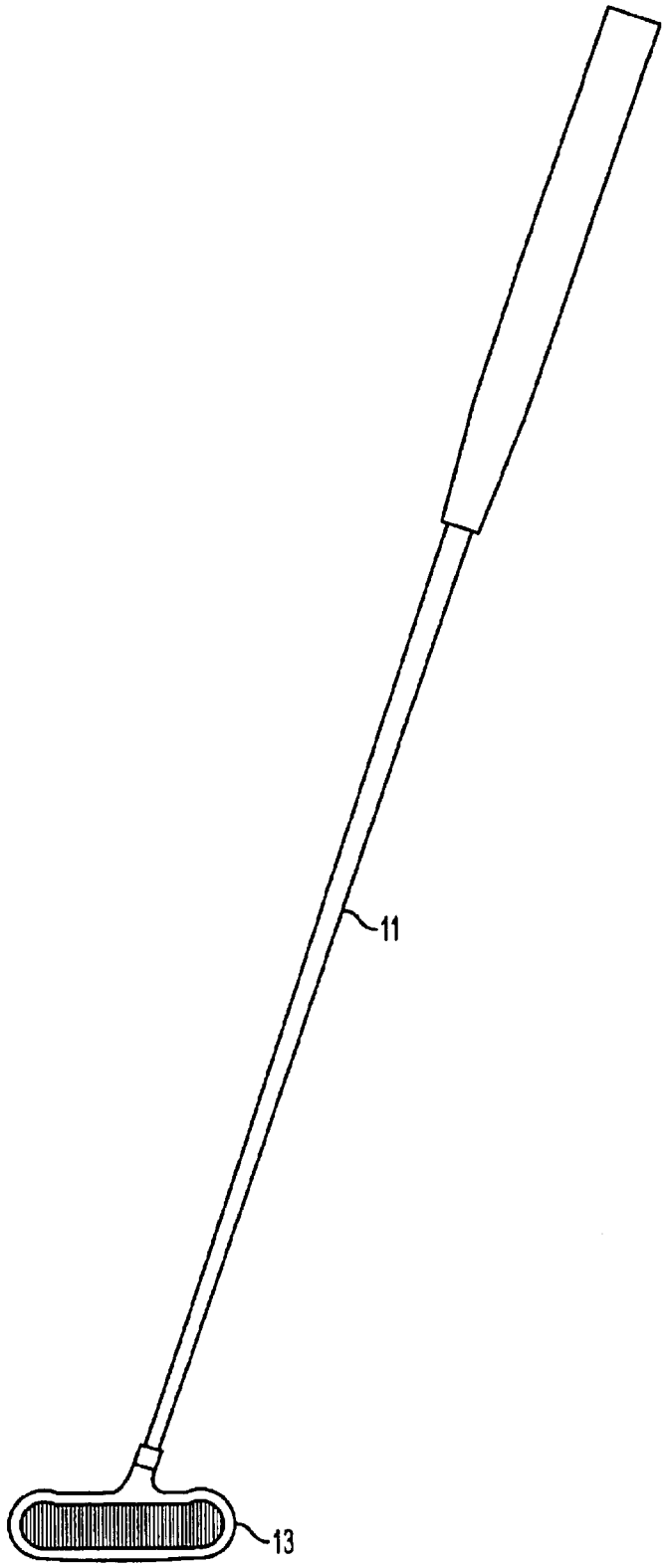
FIG. 1 is a view in elevation of the putter of the invention.
Figure 2:
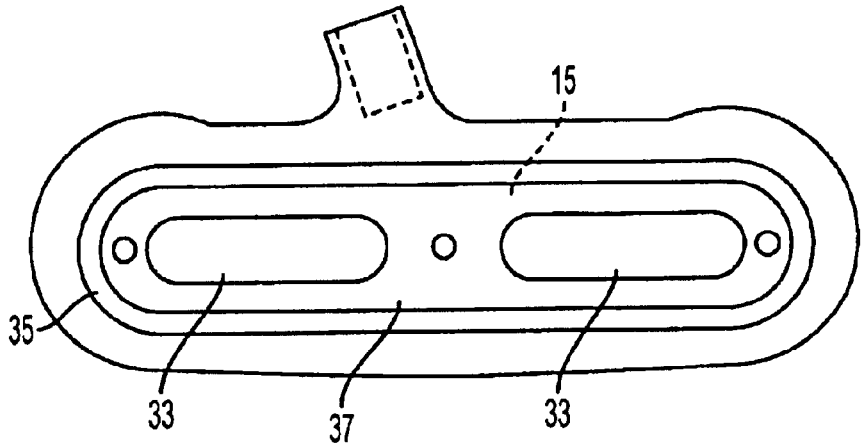
FIG. 2 is an enlarged elevation view of the back side of the putter head of the improved putter with the weights removed.

As shown in FIG. 1, the putter comprises a head 13 having an elongated shape and fixed to a shaft 11 typically about 36 inches in length, but may be considerably longer for putters using the pendulum separated hands style of putting currently used by Rocco Mediate on the PGA golf tour.

An improved putter head is illustrated in FIGS. 2–11. The putter head defines a hollow longitudinal channel 15 extending lengthwise along the putter head. Weights can be mounted to be slidable along this channel. The channel 15 is rectangular in cross section and defined in the back of the putter head body. The channel is closed by a retainer plate 31. The retainer plate 31 defines two aligned oval slots 33 centered over the channel 15 so that slides 42 are captured within the channel 15 with bolts 43 screwed into the slides 42 each extending through a different slot 33. The retainer plate 31 fits within a recess partially defined by the oval shaped ridge 35. The slides 42 as viewed in plan have at least one rounded end and flat upper and lower surfaces to guide the slide action in channel 15. The putter head can be made out of aluminum and the retainer plate 31 is brass. The retainer plate 31 is screwed to the putter body by means of three Phillips head brass screws 38.

Figure 6:
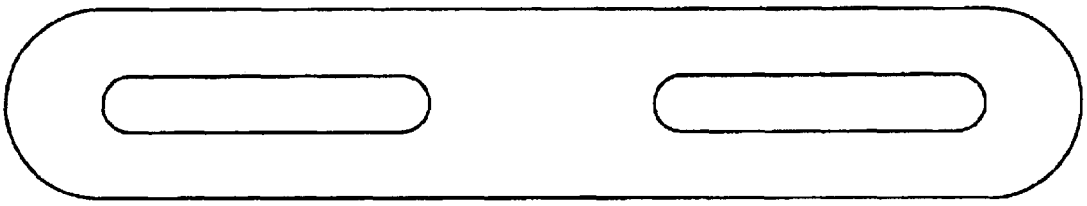
FIG. 6 is an enlarged side plan view of the shape of the retainer plate and the vibration plate of the putter head of the improved putter.

A vibration damping plate 37 is disposed between the weights and the retainer plate. FIG. 6 illustrates the shape of the vibration damping plate. The vibration damping plate is of the shape in plan view as the retainer plate 31 so that the slots 33 are defined in and extend through both plates 31 and 37. The thickness of the vibration damping plate can be 0.031 inches. The function of the vibration damping plate is to dampen vibrations within the putter head when a ball is struck by the putter head. Less vibrations allows for a purer putting strike and provides the golfer with a good feel upon striking the ball. The vibration damping plate may be manufactured out of plastic, hard rubber, or any other material that is effective to dampen vibrations. For example, the material of the vibration damping plate may be Black Delron, which is a synthetic resin or plastic material.

Figure 3:
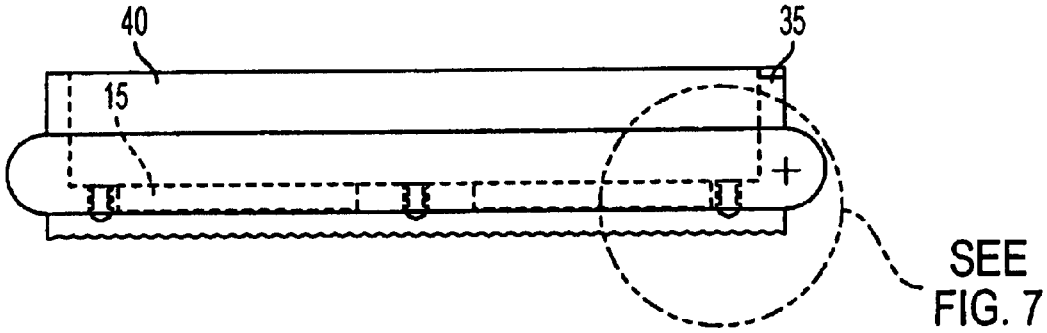
FIG. 3 is a plan view of the of the bottom of the putter head of the improved putter.
Figure 4:
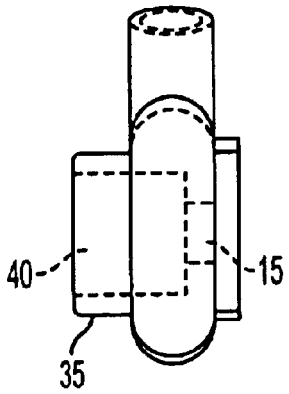
FIG. 4 is an end view in elevation of the putter head of the improved putter.
Figure 5:
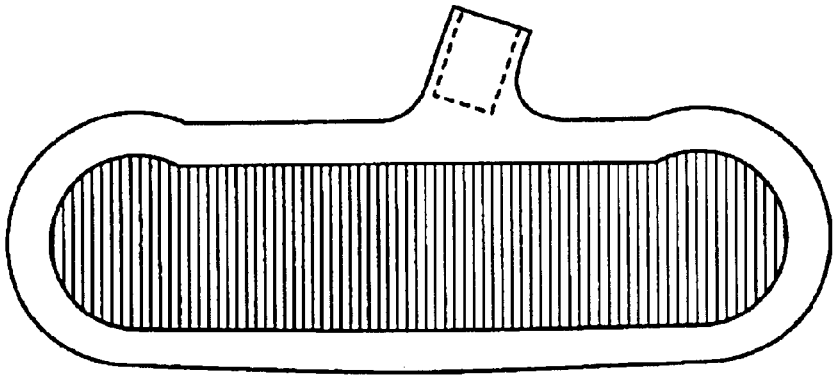
FIG. 5 is a view in elevation of the front face of the putter head of the improved putter.
Figure 8:
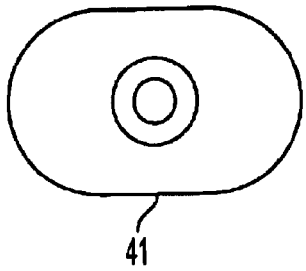
FIG. 8 is a side view of a weight to be mounted in the putter head of the improved putter.
Figure 9:
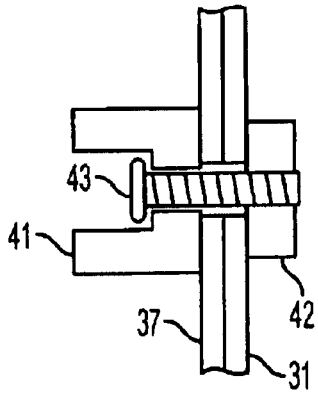
FIG. 9 is a broken sectional view showing a weight mounted in the putter head of the improved putter.
Figure 10:
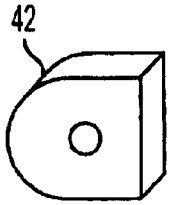
FIG. 10 is a perspective view of the slide used to mount the weights of the improved putter.
Figure 11:
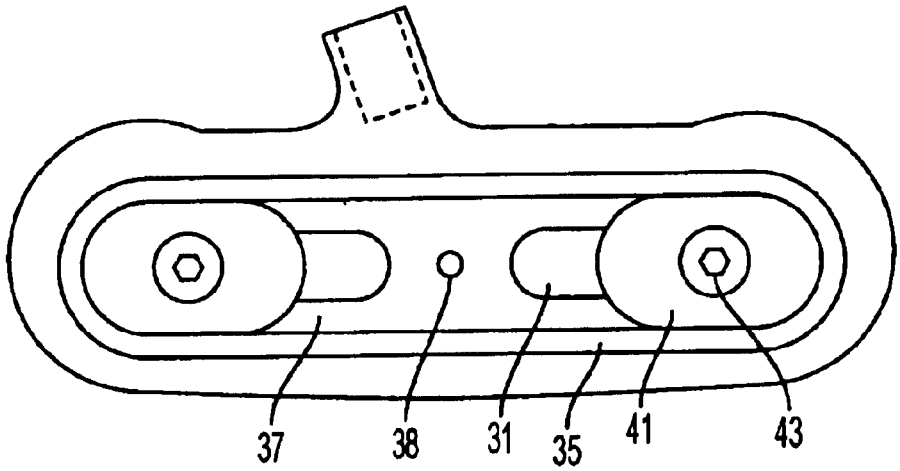
FIG. 11 is a view in elevation of the back face of the putter head of the improved putter with the weights mounted.

The ridge 35 on the back of the putter head also partially defines a outer chamber 40 having rounded ends. The outer chamber 40 is partially defined by a recess which extends into the putter head to the channel 15, as best shown in FIGS. 3 and 4. The weights are mounted such that the weights are slidable within the outer chamber 40 and make a sliding fit with the inner sidewalls of the ridge 35. FIG. 8 depicts a weight to be slidable in the putter head. FIG. 9 depicts a broken sectional view of the weight shown in FIG. 8 mounted through the slots of the retainer plate 31 and vibration damping plate 37. The slidable weight assembly comprises a slide 42, a weight 41, and a threaded bolt 43. Each weight 41 is mounted by a threaded bolt 43 extending through the center of the weight, through the slot 33 defined by the vibration damping plate 37, and secured to a slide 42 in the inner channel such that the weights 41 are able to be tightened against the retainer plate 31 also defining the slots 33. The bolts 43 in this embodiment are adapted to be loosened or tightened with an allen wrench or screw driver. To slide a weight 41, the bolt 43 passing through the weight 41 is loosened with an allen wrench or screwdriver, slid into the desired place, and tightened.

The weights 41 have rounded ends to fit with the rounded ends of the outer oval chamber 40. The ridge 35 on the back of the putter head is of a sufficient height so that the top surface of the ridge is flush with or above the outside surface of the weights 41, so that the weights are contained entirely within the chamber protected by the ridge.

As described above, both the slides and the weights have rounded ends. This feature provides the additional advantage of enabling the weights to slide across a wider range. The weights can slide to be flush against the ridge that defines the outer chamber of the putter head. At the same time, the rounded ends of the slide enable the slides to be flush against the corresponding rounded ends of the channel 15.

By having the weights mounted completely within the outer chamber, the putter head is a less cumbersome design than prior putters. The adjustable weights are mounted without unwieldy projections or protrusions from the putter head. This provides a sleeker, more streamlined putter head while at the same time permitting substantial adjustment of the sweet spot. Also, the weights are protected from receiving accidental blows which would cause the weights to come loose from a secure mounting on the putter head.

By mounting the weights within an outer chamber, the size of the weights are not limited by the size of the inner channel. Mounting weights within the outer chamber allows heavier weights. Heavier weights permit a greater sweet spot adjustment.

Figure 7:
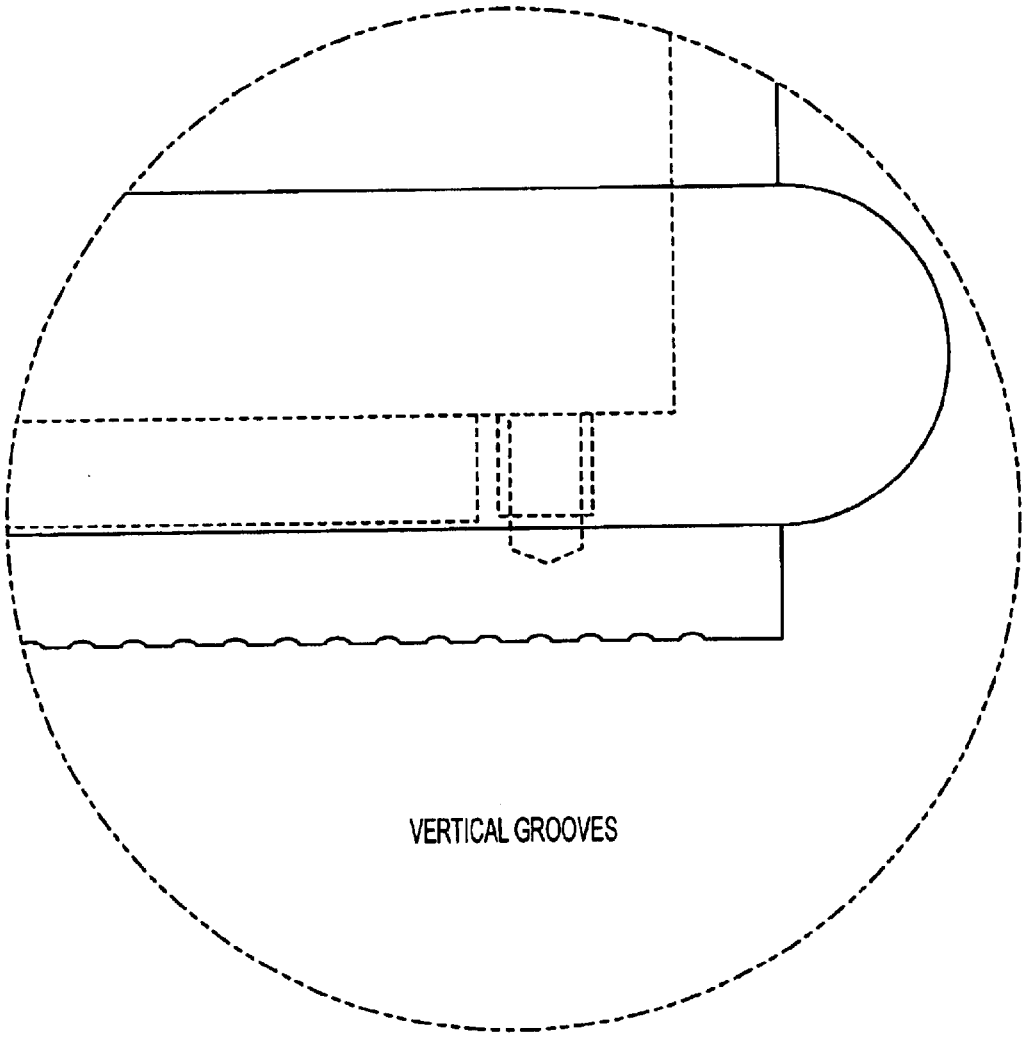
FIG. 7 is an enlarged bottom view of the portion of the putter head showing the shape of the vertical grooves of the improved putter.

The front surface of the putter head which strikes the golf ball is provided with vertical grooves. FIG. 7 illustrates a vertical groove arrangement. The grooves are contoured such that the troughs within the grooves are arcuate and the lands between grooves are flat. In the preferred embodiment, the pitch of the grooves is 13⅓ grooves per inch. The grooves are 0.009 inches deep and the arc of the grooves has a radius of 0.024 inches. The lands and grooves are the same width so as to create a 1:1 ratio between lands and grooves across the front face of the putter head. The arcuate shape of the wall of the grooves provides a sloping sidewall to the grooves to meet the requirements of the United States Golf Association. By making the grooves arcuate with sufficient radius, the required sloping sidewall is achieved in an easily manufactured configuration.

The vertical grooves tend to propel the ball more consistently in the direction of the motion of the club face than a putter with a flat striking surface. The reason for this improvement is that a golf ball is not round, but has dimples, and a perfectly flat club face will initially make contact with the ball only at one point. This point may be on a land between dimples, it may be in the middle of a dimple or it may be on the corner between the dimple and a land. When the club face strikes the ball at a corner between a dimple and a land, there is a tendency for the ball to be impelled slightly offline from the motion of the club. The grooves in the club face of the invention reduce this problem because the grooves tend to bridge across the dimples and tend to make initial contact with the ball at two points rather than one. The groove pitch, groove shape, and groove width are selected so that the putter is effective to more consistently impel a ball struck by the grooved putter face in the direction of motion of the putter head when the direction of motion is perpendicular to the plane of the front face while at the same time comply with USGA regulations.

In this embodiment, the front face of the putter is lofted at a 1.5 degree angle. The grooved front face combined with the 1.5 degree loft provides a truer spin on a ball leaving the club head upon being struck by the club head. The bottom surface 41 of the club head is rounded in a circular curve from the back face of the club head to the front face. The rounding of the bottom surface 41 reduces the chance of the front face of the putter picking up stray grass blades. The grooves on the front face of the putter are formed in a raised surface 43 which is the operative front face of the putter. It is the raised front face 43 that is lofted at the 1.5 degree angle. The bottom edge 45 of raised front face 43 is located at about 0.165 inches above the front surface of the club head. The normal putting stroke leaves a 0.3 inch gap between the bottom surface of the putter club head and the putting surface. If the golf ball to be putted is on the green, but is tucked up against the fringe at the edge of the green, the raised front face spaced about 0.25 inches above the rounded bottom surface 41 gives a cleaner stroke at the ball overcoming the disadvantage of the ball being positioned against the fringe.

The putter head as shown in FIGS. 1–11 is designed to conform with the rules the United States Golf Association. The USGA maintains specific rules dealing with the adjustability of clubs. USGA rules state that "Putters may be designed to be adjustable for weight." The rules require that "the adjustment cannot be readily made" and that "all adjustable parts are firmly fixed and there is no reasonable likelihood of them working loose during a round." By requiring the use of a tool to adjust the weights and maintaining the weights within the chamber by closing the ends of the slots, this putter has been approved for official play by the USGA.

the above description is of preferred embodiments of the invention and modifications may be made thereto without departing from the spirit and scope of the invention which is defined by the appended claims.

What is claimed is:

1. A putter comprising a putter head and a shaft fixed to said putter head, said putter head defining a hollow channel extending longitudinally in said putter head, a slot defined in said putter head in communication with said channel and extending parallel to said channel, said putter head also defining an open outer chamber extending longitudinally in said putter head and parallel to said channel, said slot providing an elongate opening between said channel and said chamber and having a width narrower than that of said channel and said chamber;

a weight slidably mounted within said outer chamber with a bolt extending through said slot between a slide within said channel and said weight, said bolt being adapted to be screw tightened to hold said weight in position.

2. A putter as recited in claim 1, wherein said outer chamber has closed rounded ends.

3. A putter as recited in claim 2, wherein said outer chamber has a depth at least as great as the width of the weight whereby the weight is mounted completely within the outer chamber.

4. A putter as recited in claim 1, further comprising a vibration damping plate defining said slot and sandwiched between said weight and said slide.

5. A putter as recited in claim 1, wherein said hollow channel has a rectangular cross section and said slide has a rectangular cross section and at least one rounded end.

6. A putter as recited in claim 1, wherein a plurality of weights are mounted in said putter head in a manner permitting the position of said weights to be adjusted along the length of said putter head.

7. A putter comprising a putter head, said putter head defining a hollow channel extending longitudinally in said putter head, a slot defined in said putter head communicating with said channel and extending parallel to said channel, a weight mounted on said putter head in a manner permitting the position of said weight to be slid to different positions along the length of said putter head, said weight being mounted on said putter head by a bolt extending through said slot between said weight and a slide within said channel and a plate made of vibration damping material sandwiched between said weight and said slide.

8. A putter a recited in claim 7, wherein a plurality of weights are mounted in said putter head in a manner permitting the position of said weights to be slid along the length of said putter head, said plate of vibration damping material being sandwiched between said weights and slide within said channel.

9. A putter as recited in claim 8, wherein said weights are held in position against said vibration damping plate by screw tightened bolts.

10. A putter comprising a putter head, a shaft fixed to said putter head, parallel vertical grooves defined in a front face of said putter head, said grooves being separated by flat lands between said grooves, said grooves being arcuate in cross section and being shaped so that the sidewalls of said grooves adjacent to said lands slope at an angle substantially less that perpendicular to said lands.

* * * * *